US005694652A

United States Patent [19]

Stock et al.

[11] Patent Number: 5,694,652

[45] Date of Patent: Dec. 9, 1997

[54] FLUSHING SYSTEM

[75] Inventors: Michael John Stock, 28 Buckhurst Road, Bexhill-on-Sea, East Sussex, TN40 1QE; Christopher John Richmond, Bexhill-on-Sea, both of England

[73] Assignee: Michael John Stock, East Sussex, England

[21] Appl. No.: 379,483

[22] PCT Filed: Jul. 13, 1993

[86] PCT No.: PCT/GB93/01461

§ 371 Date: May 30, 1995

§ 102(e) Date: May 30, 1995

[87] PCT Pub. No.: WO94/02690

PCT Pub. Date: Feb. 3, 1994

[30] Foreign Application Priority Data

| | | | |
|---|---|---|---|
| Jun. 4, 1992 | [GB] | United Kingdom | 9218790 |
| Jul. 25, 1992 | [GB] | United Kingdom | 9215845 |
| Sep. 21, 1992 | [GB] | United Kingdom | 9219847 |

[51] Int. Cl.[6] ..... E03D 1/06

[52] U.S. Cl. ..... 4/328

[58] Field of Search ..... 4/328

[56] References Cited

U.S. PATENT DOCUMENTS

| | | | |
|---|---|---|---|
| 255,485 | 3/1882 | Boyle . | |
| 291,139 | 1/1884 | Boyle | 4/328 |
| 380,854 | 4/1888 | Boyle . | |
| 391,318 | 10/1888 | Harkins . | |
| 461,218 | 10/1891 | Boyle . | |
| 530,306 | 12/1894 | Harvey . | |
| 534,689 | 2/1895 | Hamilton . | |
| 541,274 | 6/1895 | Hamilton . | |
| 558,130 | 4/1896 | Wallace . | |
| 3,224,013 | 12/1965 | Tubbs . | |
| 5,142,712 | 9/1992 | Hennessy . | |

FOREIGN PATENT DOCUMENTS

| | | |
|---|---|---|
| 820833 | 9/1959 | United Kingdom . |
| 1207/1875 | 4/1974 | United Kingdom . |

*Primary Examiner*—Charles E. Phillips

[57] ABSTRACT

The invention provides a toilet flushing system comprising a water reservoir provided with a water inlet, and a water outlet for directing water into or towards an associated toilet bowl; a discharge chamber communicating with the discharge outlet of the toilet bowl, the discharge chamber having at a downstream location thereof an exit opening provided with closure means; and air conduit extending between an upper end of the water reservoir and the discharge chamber such that reductions in air pressure within the upper end of the water reservoir caused by a fall in water level in the water reservoir are transmitted to the discharge chamber to produce temporarily a partial vacuum therein thereby to draw water from the toilet bowl through the discharge chamber.

34 Claims, 6 Drawing Sheets

FLUSHING SYSTEM

This invention relates to a vacuum assisted toilet flushing system.

Toilet flushing systems are well known and generally have either a wash down or vacuum assisted mode of operation. A typical toilet flushing system comprises a water reservoir, a toilet pan or bowl, and a discharge outlet connected to a waste pipe. A problem with the toilet flushing systems currently available is that relatively large volumes of water are required to flush the toilet bowl. In recognition of this problem, it has been proposed that all new toilet flushing systems should be adapted such that the maximum volume of water utilised in a single flushing operation is 7 litres. However, this is still a large volume of water, and there remains a need for a toilet flushing system which utilises smaller volumes of water.

It is an object of the present invention to overcome the aforesaid problems and to provide a toilet flushing system which in general requires much smaller volumes of flushing water.

The present invention achieves this objective by means of the creation of a partial vacuum to assist the flushing operation; and uses the energy of moving water as it descends, to create and maintain a sufficient partial vacuum at the pan outlet to assist pan discharge into a discharge chamber. The discharge chamber is fitted with a one way valve means which facilitates vacuum generation prior to entering the drainage system.

More particularly the present invention provides a toilet flushing system comprising a water reservoir provided with a water inlet, and a water outlet for directing water into or towards an associated toilet bowl;

a discharge chamber communicating with the discharge outlet of the toilet bowl, the discharge chamber having at a downstream location thereof an exit opening provided with closure means;

an air conduit extending between an upper end of the water reservoir and the discharge chamber such that reductions in air pressure within the upper end of the water reservoir caused by a fall in water level in the water reservoir are transmitted to the discharge chamber to produce temporarily a partial vacuum therein thereby to to draw water from the toilet bowl through the discharge chamber.

In one embodiment, the water reservoir is provided with an air inlet and means for closing the air inlet in response to a fall in water level in the reservoir. For example, the means for closing the air inlet can be a flap, plunger or valve operatively linked to a float.

The water reservoir can be provided with a siphonic mechanism of known type, actuation of the siphonic mechanism serving to initiate the fall in water level in the reservoir, thereby generating the partial vacuum. Where such a mechanism is included, an air pipe can be provided which extends between a downpipe of the siphonic mechanism and the interior of the water reservoir such that initial actuation of the siphon displaces a limited volume of air from the downpipe to the interior of the water reservoir.

The closure means at the exit opening of the discharge chamber can be undirectional For example the closure means can take the form of a one-way flap valve. Where desired, the flap valve can be connected to a plunger or lever enabling the valve to be closed manually in the unlikely event that it sticks in an open position during use.

Alternatively, the exit opening can be sealed by means of a water trap, for example a U-bend water trap.

In a further aspect, the invention provides a toilet flushing system as defined hereinabove, in combination with a toilet bowl adapted to be fitted with the said toilet flushing system.

Preferably, the water inlet of the reservoir is configured to allow controlled re-filling of the reservoir after a fall in the level of water therein, and most preferably the water inlet is linked to a second water reservoir provided with a float valve metered water supply.

Specific embodiments of the invention will now be described by way of example, with reference to the accompanying drawings, in which.

Figure 1:
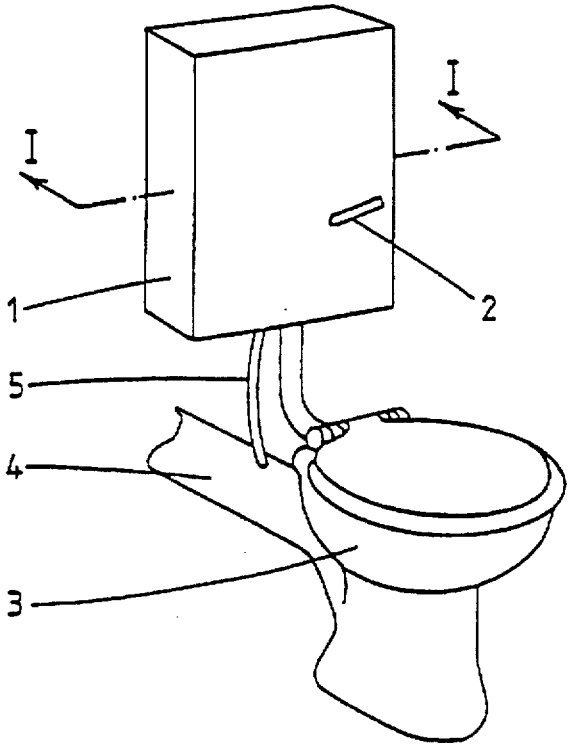
FIG. 1 is an isometric view illustrating the water reservoir, toilet bowl and discharge facility of a toilet flushing system according to one embodiment of the invention.
Figure 3:
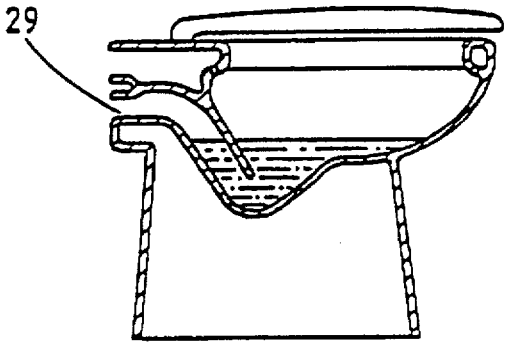
FIG. 3 is a side elevation in cross-section of the toilet bowl shown in FIG. 1.

Referring now to the Figures, it can be seen from FIG. 1 that the toilet flushing system comprises a casing 1 within which is located the water reservoir and associated apparatus, a handle 2 for initiating the flushing action, a toilet bowl 3 to the outlet of which is connected discharge chamber 4, and a pipe 5 which serves as an air conduit between the water reservoir and discharge chamber.

Figure 2:
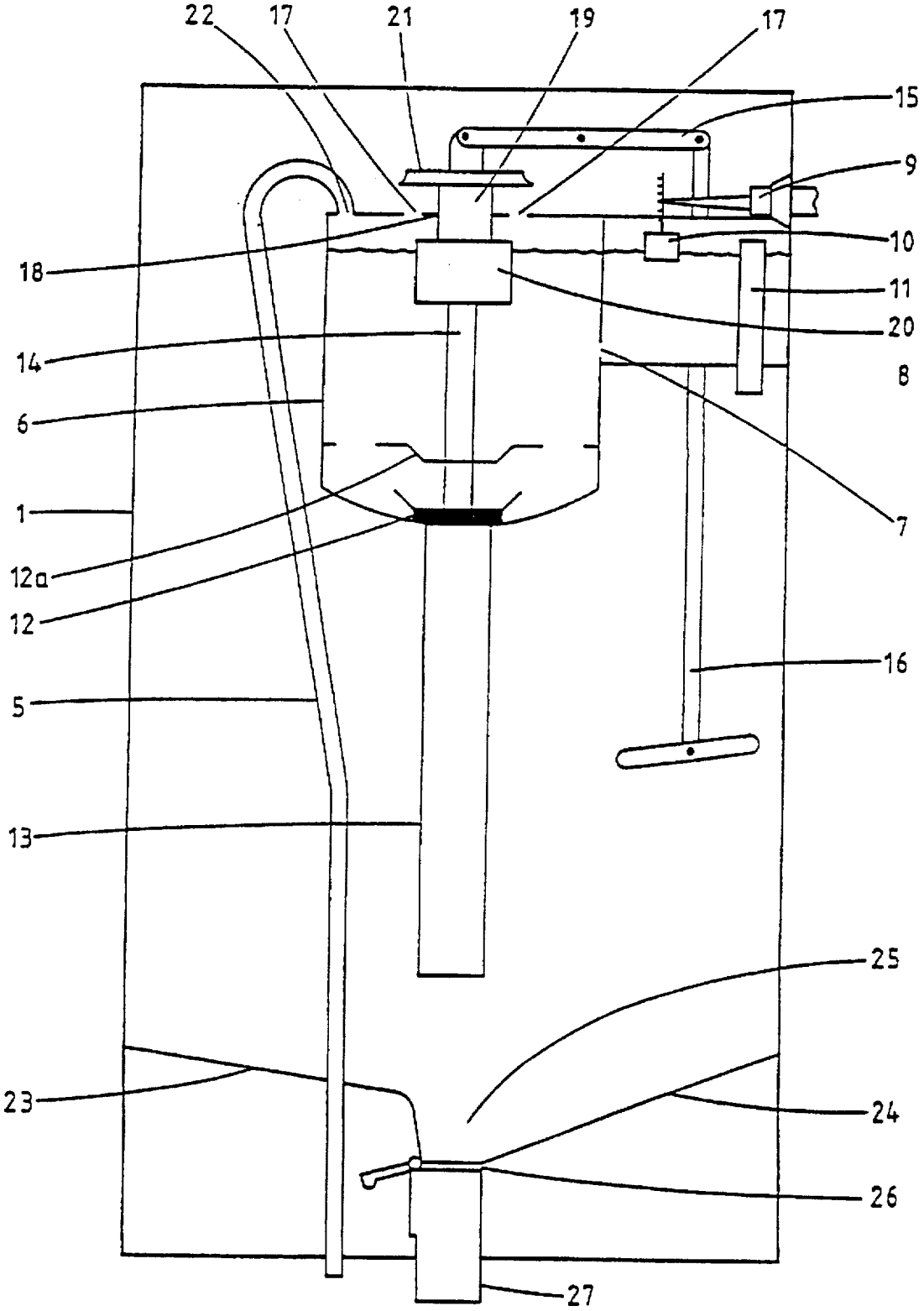
FIG. 2 is a schematic sectional view along line I—I of FIG. 1.

As shown in FIG. 2, the casing 1 contains a water reservoir 6 provided with a water inlet 7 of restricted diameter leading to a float valve chamber 8. A float 10 linked to float valve 9 controls entry of water into float valve chamber 8, and the chamber is provided with overflow pipe 11 in standard fashion. At the lower end of water reservoir 6 is a valve 12 which controls the flow of water into outlet pipe 13. Valve 12 is connected via mechanical linkages 14, 15 and 16 to the handle 2.

At the upper end of the water reservoir 6 are located air inlets 17 and an aperture 18 in which is slidably received a shaft 19. A float 20 is secured to the lower end of shaft 19, and to the upper end of shaft 19 is secured a flap valve element 21, which is arranged to seal air inlets 17.

Also located in the upper end of the water reservoir 6 is an opening 22 which is connected via pipe 5 to the interior of discharge chamber 4. Pipe 5 thus serves as an air conduit between the interior of the water reservoir 6 and the interior of the discharge chamber 4.

Figure 7:
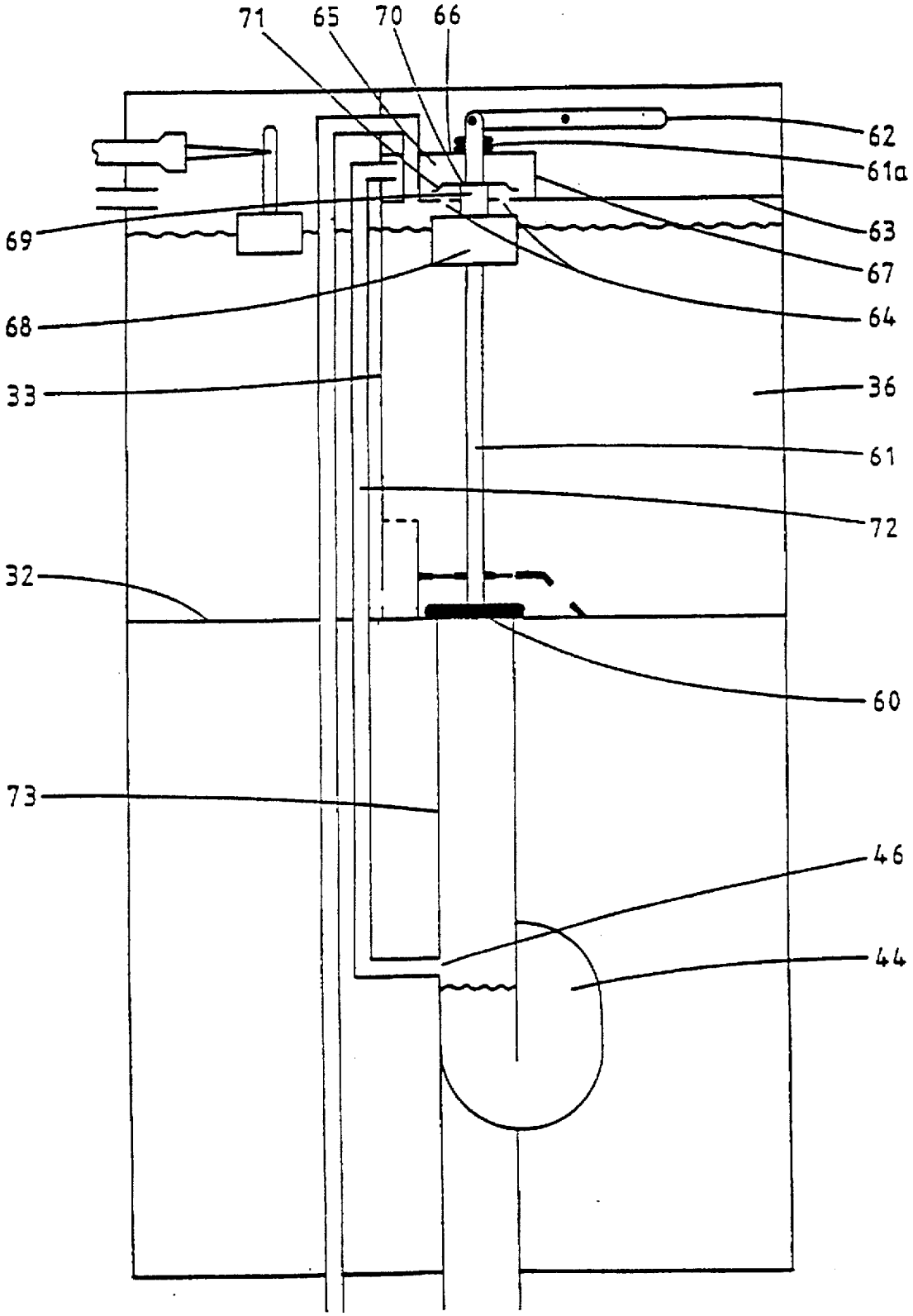
FIG. 7 is a schematic sectional view along line I—I in FIG. 1 but illustrating a different layout within casing 1.
Figure 8:
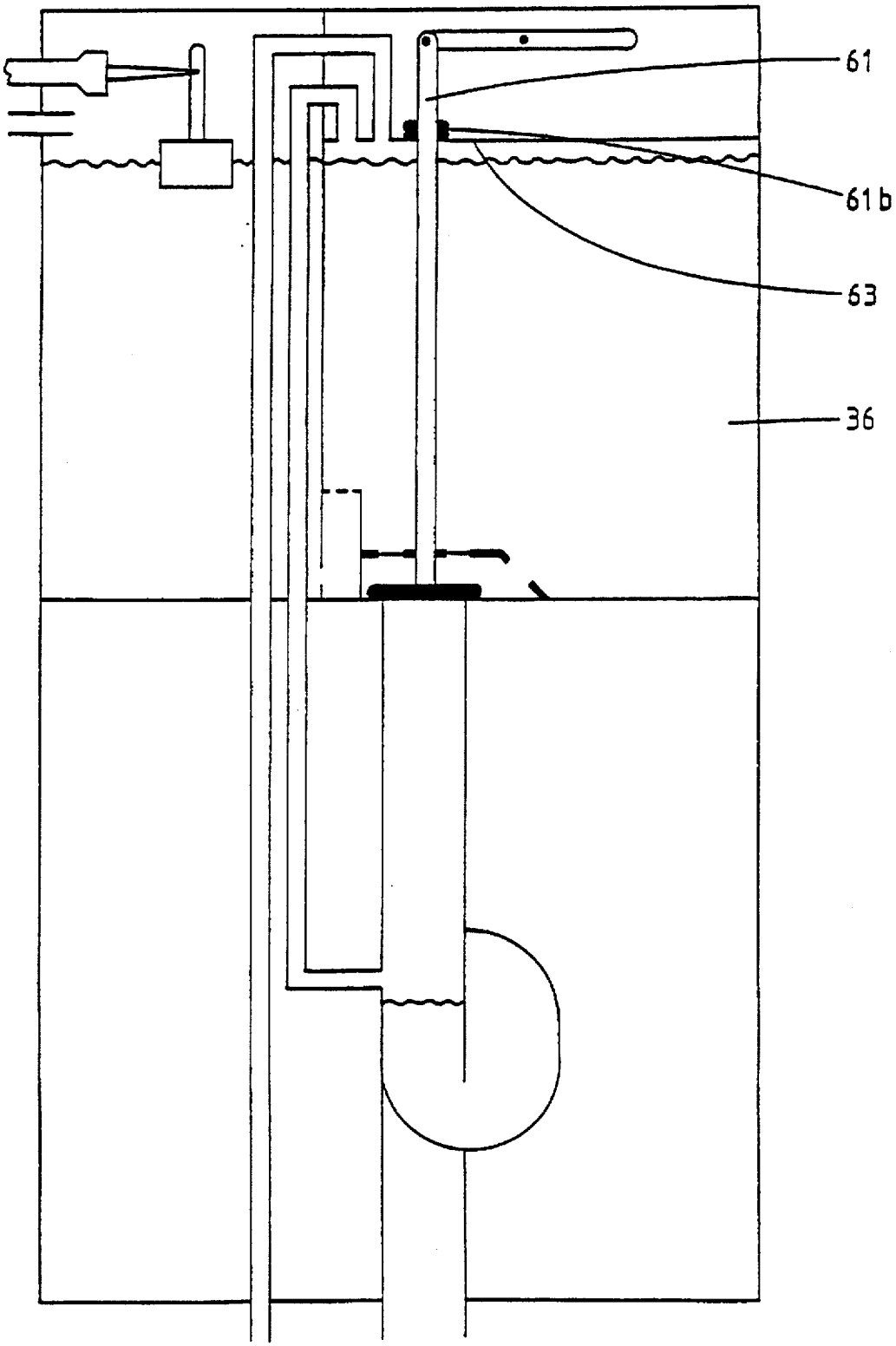
FIG. 8 is also a schematical sectional view along I—I in FIG. 1 but illustrating a layout within casing 1 in accordance with a further embodiment of the invention.

Towards the lower end of casing 1 are sloping surfaces 23 and 24 which define a trough 25 for collecting water discharged through outlet pipe 13. At the bottom of the trough 25 is an isolating valve 26 which controls flow of water from the flushing system into the pipe 27 linked to the toilet bowl 3. Isolating valve 26 could be replaced by a standard U-bend, as illustrated in FIGS. 7 and 8.

Figure 4:
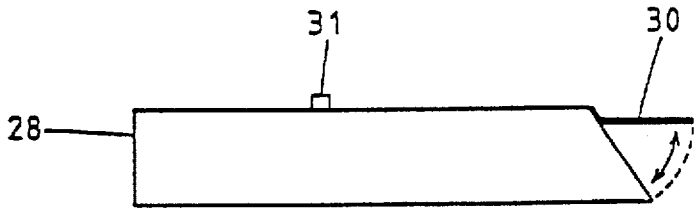
FIG. 4 is a side elevation of the discharge chamber shown in FIG. 1.
Figure 5:
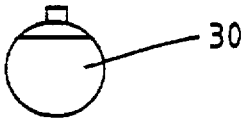
FIG. 5 is an end view of the downstream end of the discharge chamber of FIG. 4.

Turning now to FIG. 4, it can be seen that the discharge chamber 4 is arranged at an end 28 to be secured to the discharge outlet 29 of the toilet bowl 3. At its downstream end, the discharge chamber 4 is provided with a flap valve 30 which permits water to flow out of the chamber 4 but prevents the passage of water in the reverse direction. Air conduit 5 is connected to the discharge chamber 4 at location 31 on the upper part of the discharge chamber 4.

In use, the flushing cycle is initiated by turning handle 2 which, by means of mechanical linkage 14, 15, 16 lifts valve 12 away from the mouth of outlet pipe 13 and into contact with stop element 12*a*. Water thus passes out through the opening down outlet pipe 13 and into the trough 25, whereupon it passes through isolating valve or U-bend 26 and down pipe 27 into the toilet bowl 3.

As the water level in reservoir 6 falls, float 20 moves downwardly with the water level until the flap valve element 21 is in sealing engagement over the air inlets 17. At this point, further fall of the water level in the reservoir leads to the creation of a partial vacuum in the head space above the falling water level, and this partial vacuum is transmitted via air conduit 5 to the discharge chamber 4. Flap valve 30 in the discharge chamber 4 assists in the maintenance of the partial vacuum, which causes water from the toilet bowl to be drawn through the discharge outlet and into the discharge chamber, from which it passes through the exit opening closed by flap valve 30 to waste.

The water level within the reservoir 6 is replenished by water from the float valve chamber 8 which is re-filled from float valve 9 as the float 10 falls with the water level.

The advantage of the flushing system of the present invention is that by virtue of the vacuum created within the discharge chamber 4, water in the toilet bowl is drawn rapidly through the discharge opening, with the consequence that much smaller volumes of flushing water are required. It has been found that effective flushing of a toilet bowl, even in the presence of blockages within the discharge outlet, can be effected with flushing volumes of only 4 litres.

Figure 6:
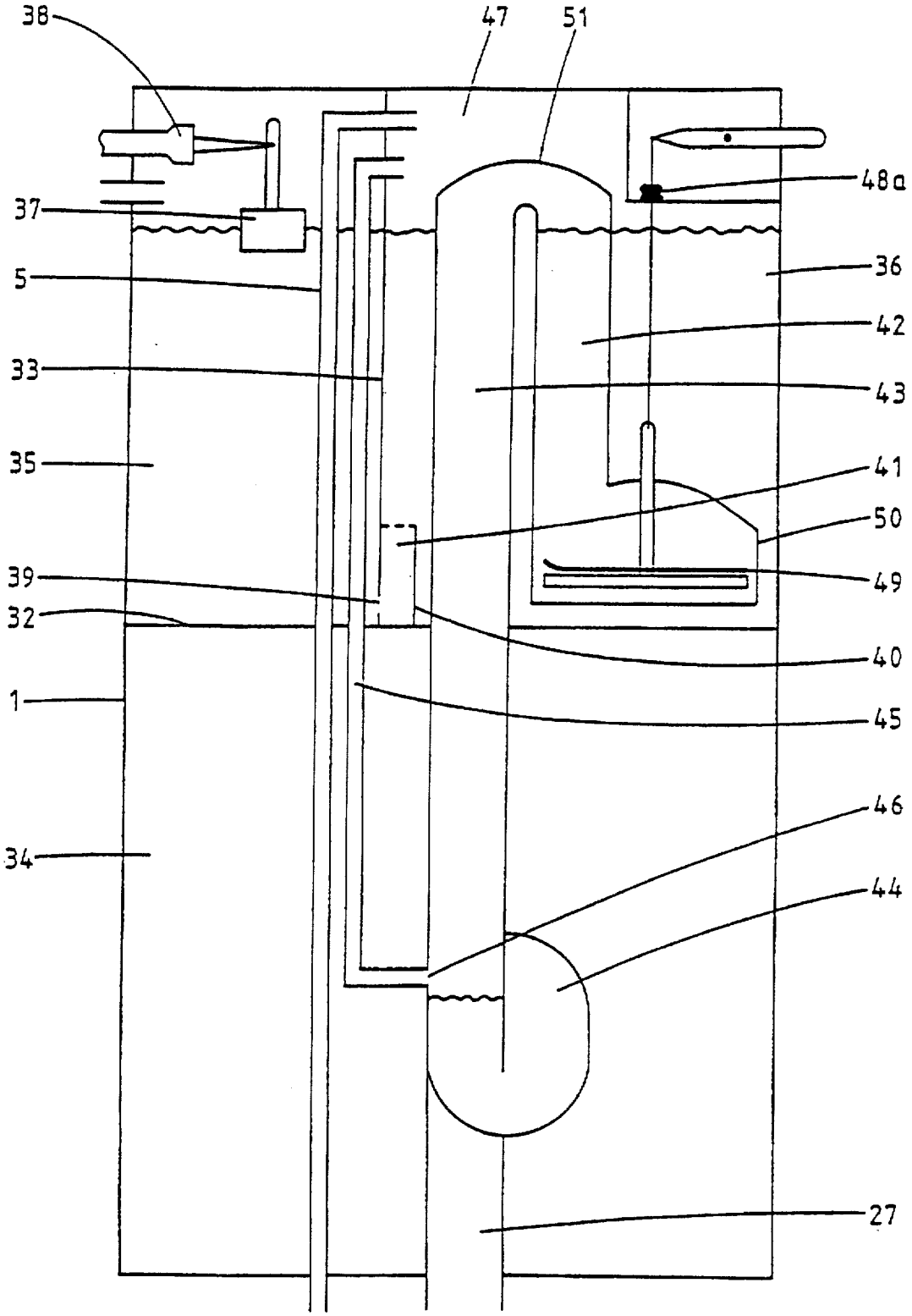
FIG. 6 illustrates schematically the water reservoir arrangement of a second embodiment of the invention.

A second embodiment of the invention is illustrated in FIG. 6, in which there is shown a casing 1 corresponding to the casing 1 shown in FIG. 1. Internal partition walls 32 and 33 divide the interior of the casing into lower chamber 34, float valve chamber 35 and water reservoir 36. A float 37 linked to float valve 38 controls flow of water into chamber 35 in standard fashion. At the lower end of partition wall 33 is an opening 39 which serves as a water inlet for the water reservoir 36. Located close to the opening 39 is partition wall 40 which, together with partition wall 33 can serve as a water trap 41 separating the two chambers when the water levels inside chambers 35 and 36 fall to their minimum levels. Disposed inside the water reservoir 36 is a siphonic mechanism 42 which can be of conventional construction, although a specifically designed siphon with consequential alterations may be advantageous in certain applications. The downpipe 43 of the siphon extends through partition wall 32 and is connected via U-bend 44 to outlet pipe 27 which in turn is linked to the toilet bowl 3. An air pipe 45 is connected to the downpipe 43 of the siphon via opening 46 end extends through partition wall 32 to vent into the upper end 47 of the water reservoir chamber. Also extending between the upper end 47 of the water reservoir 36 and lower chamber 34, is the air conduit 5 which passes out through the lower end of the casing 1 and communicates with discharge chamber 4 as illustrated in FIGS. 1 and 4.

To actuate the flushing mechanism, handle 2 is turned as with the first embodiment. As the handle 2 is turned, mechanical linkage 48, which extends into chamber 36 through seal 48*a*, lifts the piston and plunger arrangement 49 inside the bell-end 50 of the siphon thereby causing water to be displaced through the inverted U-bend 51 into the downpipe 43 to initiate the siphonic action. As water passes through U-bend 51 into the downpipe 43, the air present in the downpipe is displaced through opening 46 into airpipe 45 and thence into the upper end 47 of the water reservoir 36. This has the effect of initially partially relieving the partial vacuum created inside the upper end 47 of the water reservoir 36, thereby initially assisting the siphonic action. A further benefit arising from airpipe 45 is that air entering the reservoir 36 through air conduit 5 is recycled through the reservoir and is not expelled into the toilet bowl.

As the water level within reservoir 36 falls, the partial vacuum generated within the upper end 47 of the reservoir is transmitted through air conduit 5 to the discharge cheer 4 to assist emptying of the toilet bowl 3 as described in relation to FIGS. 1 to 5.

The water level in the water reservoir 36 is replenished by restricted flow through the opening 39 from the float chamber 35.

An advantage of the embodiment illustrated in FIG. 6 is that the system is substantially sealed against emission of air from the interior of the casing 1 into the surrounding environment. Thus, at its lower and, the system comprises U-bend 44 which prevents air escape through discharge pipe 27 into the toilet bowl 3. The only other opening to the exterior is air conduit 5 which communicates with discharge chamber 4.

The siphonic mechanism illustrated can readily be adapted to provide a dual flush facility and it has been found that with the apparatus shown in FIG. 6, a mere 2.5 litres of flush water is required for the shorter flushing action whereas the longer flushing action necessary to remove solid waste from the toilet bowl 3 can be accomplished using only 3.5 litres of flushing water.

It has also been found that the level of vacuum generated within the flushing system increases with the height of the water reservoir above the toilet bowl. However, even with low flush systems currently favoured by domestic consumers the flushing apparatus of the present invention still enables efficient and complete toilet flushing to be achieved using the low values of flush water referred to above.

The embodiment illustrated in FIG. 6 can be modified by the incorporation of a flap, plunger or valve operatively linked to a float mechanism to allow a restricted flow of air into the water reservoir chamber, for example as illustrated in FIGS. 1 to 5.

FIG. 7 illustrates a modification to the embodiment shown in FIG. 6 wherein the siphonic mechanism of FIG. 6 has been replaced by a float actuated flap valve and plunger assembly of the type shown in FIG. 2. Thus, in place of the siphon, there is provided a valve 60 which is connected via mechanical linkages 61 and 62 through seal 61*a* in partition wall 66 to a handle 2 in a manner analogous to that shown in FIG. 2. At the upper end of the water reservoir 36 is a partition wall 63 having openings 64 which communicate with chamber 65 defined by walls 66 and 67. Float 68 is secured to the lower end of a shaft 69 which is slidably received in an aperture 70 in wall 63. A flap valve element 71 is secured to the upper end of shaft 69 and functions in the manner described in respect of FIG. 2. Air conduit 5 extends through partition walls 32, 33 and 66, opening out into water reservoir 36. An air pipe 72, which communicates at its lower end through opening 46 just above U-bend 44, extends between downpipe 73 and the chamber 65. Air pipe 72 functions in a manner analogous to air pipe 45 shown in FIG. 6. Thus, as valve 60 is lifted to initiate the draining of the water reservoir 36, air in the downpipe 73 is displaced through air pipe 72 and into chamber 65, from which it can enter the upper end of the water reservoir through openings 64, thereby to provide initial partial relief of the developing partial vacuum within the water reservoir 36.

In FIG. 8, there is illustrated a flushing system similar to that shown in FIG. 7 except that the float-operated flap valve assembly 68, 69, 71 and air inlets 64 have been omitted. Also in this embodiment, mechanical linkage arm 61 extends directly through a seal **61*b* in partition wall 63 into the water reservoir 36**.

Figure 9:
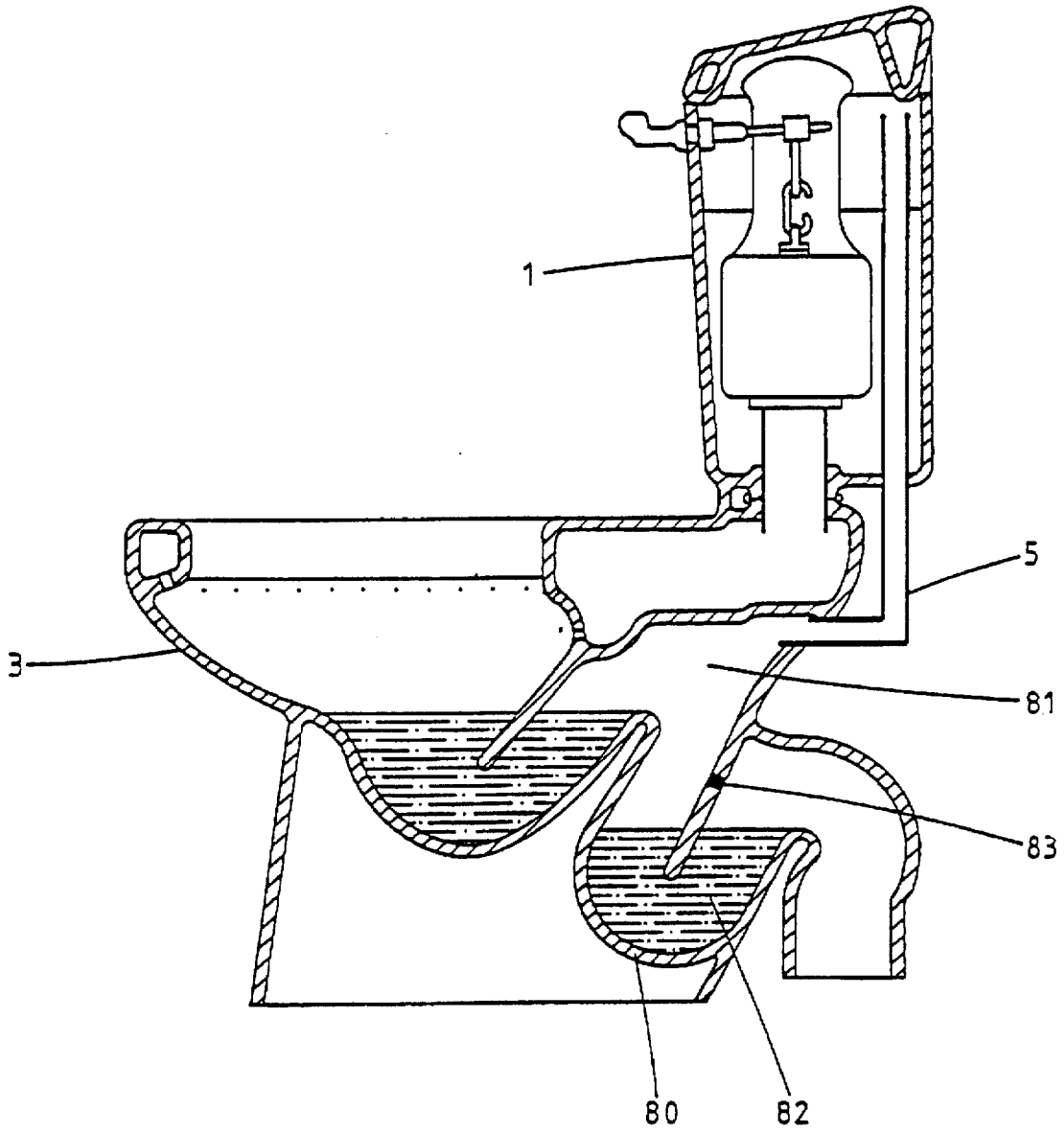
FIG. 9 is a side elevation in cross-section of a third embodiment of the invention.

FIG. 9 illustrates a modification to the toilet bowl and discharge chamber arrangement. In this embodiment, the toilet pen casting 3' is provided with a second U-bend water trap arrangement 80, and the discharge chamber is defined by the air space 81 between the two U-bend traps, air conduit 5 opening out into the upper end of space 81. In this instance, the water 82 in the U-bend 80 functions as the closure means and takes the place of the flap valve 30 illustrated in FIG. 4.

In a further embodiment of the invention the interior of the water reservoir can be further isolated by incorporating a diaphragm arrangement fitted e.g. between the water reservoir and the discharge chamber, displacement of the diaphragm serving to transmit variations in pressure from one side of the diaphragm to the other. For example, in each of the aforementioned embodiments, a diaphragm arrangement could be fitted between discharge chamber 4 and air conduit 5.

Discharge chamber 4 may vary in size and shape to enhance function and to suit different pan and soil pipe configurations, more specifically, it may for example, be part of the pan itself in a similar aspect to the double trap pan illustrated in FIG. 9. Alternatively it may be preferable to fit the chamber within the soil pipe, or to use the soil pipe itself as the chamber by fitting valve element 30 together with an appropriate collar, at a predetermined point so as to accommodate the appropriate volume. In such an embodiment the soil pipe would also need to accommodate conduit 5, connector 31.

Turning again to the double trap pan configuration illustrated in FIG. 9, a one way valve element can be fitted to enhance re-filling of the water reservoir; for example, if the cistern illustrated in FIG. 6 were used the valve could be fitted at the top of tank partition 33. Alternatively, or additionally, such a valve could be fitted between the vacuum chamber and the soil pipe, for example, at location 83 in FIG. 9. This would enable air normally expelled through valve 30 in the single trap configuration to be expelled during the re-filling process.

Generally, vacuum generated in chamber 5 in the two trap system is maintained for a longer period during the flushing cycle than with the single trap valve discharge chamber arrangement. In some instances, for example if the discharge chamber is too small, too much vacuum can be created which could adversely affect the pan discharge.

To alleviate this problem if it arises with a particular pan design, vacuum generation can be reduced for example by allowing air to enter the water reservoir 36 through a hole of restricted diameter. Alternatively, a valve could be incorporated which would open allowing vacuum to be reduced having first reached a predetermined level. This valve could take the form of a spring of predetermined strength acting on a closing element, for example a spherical element sealing off a hole of predetermined diameter. Such a valve could also be incorporated in cisterns fitted to single trap pans if desired.

It will readily be apparent that numerous other modifications and alterations can be made to the apparatus illustrated in the accompanying drawings without departing from the underlying principles of this invention. The application is intended to embrace all such modifications and alterations.

We claim:

1. A toilet flushing system comprising a water reservoir provided with a water inlet, and a water outlet for directing water to an associated toilet bowl, the water reservoir having an upper end;

a discharge chamber connected to a discharge outlet of the toilet bowl; the discharge chamber having at a downstream location thereof an exit opening provided with closure means for closing the exit opening;

an air conduit extending from a first air inlet in the upper end of the water reservoir to the discharge chamber such that a reduction in air pressure within the upper end of the water reservoir produces temporarily in the discharge chamber a partial vacuum thereby to draw water from the toilet bowl into the discharge chamber;

a second air inlet in the upper end of the water reservoir; and means for closing the second air inlet in response to a fall in water level in the reservoir.

2. A toilet flushing system according to claim 1 wherein the means for closing the second air inlet is selected from the group consisting of a flap, a plunger and a valve operatively linked to a float.

3. A toilet flushing system according to claim 1 wherein the closure means at the exit opening of the discharge chamber is uni-directional.

4. A toilet flushing system according to claim 3 wherein the closure means takes the form of a one-way flap valve.

5. A toilet flushing system according to claim 1 wherein the closure means at the exit opening is defined by a water trap.

6. A toilet flushing system according to claim 5 wherein the water trap is a U-bend water trap.

7. A toilet flushing system according to claim 1 wherein the water inlet is of restricted diameter relative to the water outlet so as to allow controlled refilling of the reservoir after a fall in the level of water therein.

8. A toilet flushing system according to claim 7 wherein the water inlet is linked to a second reservoir provided with a float valve.

9. A toilet flushing system according to claim 8 wherein the water inlet is linked to the second reservoir via a water trap.

10. A toilet flushing system according to claim 1 wherein the water outlet comprises an outlet pipe provided with a U-bend defining a water trap which prevents air escape into the toilet bowl.

11. A toilet flushing system comprising a water reservoir provided with a water inlet, and a water outlet for directing water to an associated toilet bowl, the water reservoir having an upper end;

a discharge chamber connected to a discharge outlet of the toilet bowl, the discharge chamber having at a downstream location thereof an exit opening provided with closure means for closing the exit opening;

an air conduit extending between the upper end of the water reservoir and the discharge chamber such that a reduction in air pressure within the upper end of the water reservoir caused by a fall in water level in the water reservoir produces temporarily in the discharge chamber a partial vacuum thereby to draw water from the toilet bowl into the discharge chamber;

and an air pipe which extends between a down pipe from the water reservoir and the interior of the water reservoir such that initial outflow of water from the reservoir through the downpipe displaces a limited volume of air from the downpipe to the interior of the water reservoir thereby to provide initial partial relief of the reduction in air pressure in the water reservoir.

12. A toilet flushing system according to claim 11 which is provided with a siphonic mechanism disposed within the water reservoir, actuation of the siphonic mechanism serving to initiate the fall in water level in the reservoir thereby generating the partial vacuum.

13. A toilet flushing system according to claim 12 wherein siphonic mechanism is adapted to provide a dual flush.

14. A toilet flushing system according to claim 11 wherein the closure means at the exit opening of the discharge chamber is uni-directional.

15. A toilet flushing system according to claim 14 wherein the water trap is a U-bend water trap.

16. A toilet flushing system according to claim 11 wherein the closure means takes the form of a one-way flap valve.

17. A toilet flushing system according to claim 16 wherein the closure means at the exit opening is defined by a water trap.

18. A toilet flushing system according to claim 11 wherein the water inlet is of restricted diameter relative to the water outlet so as to allow controlled refilling of the reservoir after a fall in the level of water therein.

19. A toilet flushing system according to claim 18 wherein the water inlet is linked to a second reservoir provided with a float valve.

20. A toilet flushing system according to claim 19 wherein the water inlet is linked to the second reservoir via a water trap.

21. A toilet flushing system according to claim 11 wherein the water outlet comprises an outlet pipe provided with a U-bend defining a water trap which prevents air escape into the toilet bowl.

22. A toilet flushing system comprising a toilet bowl and a flushing system;

the flushing system comprising a water reservoir provided with a water inlet, and a water outlet for directing water into the toilet bowl, the water reservoir having an upper end;

a discharge chamber connected to a discharge outlet of the toilet bowl; the discharge chamber having at a downstream location thereof an exit opening provided with closure means for closing the exit opening;

an air conduit extending from a first air inlet in the upper end of the water reservoir to the discharge chamber such that a reduction in air pressure within the upper end of the water reservoir produces temporarily in the discharge chamber a partial vacuum thereby to draw water from the toilet bowl into the discharge chamber;

a second air inlet in the upper end of the water reservoir; and means for closing the second air inlet in response to a fall in water level in the reservoir.

23. A toilet system comprising a toilet bowl and a flushing system;

the flushing system comprising a water reservoir provided with a water inlet, and a water outlet for directing water into the toilet bowl, the water reservoir having an upper end;

a discharge chamber connected to a discharge outlet of the toilet bowl, the discharge chamber having at a downstream location thereof an exit opening provided with closure means for closing the exit opening;

an air conduit extending between the upper end of the water reservoir and the discharge chamber such that a reduction in air pressure within the upper end of the water reservoir caused by a fall in water level in the water reservoir produces temporarily in the discharge chamber a partial vacuum thereby to draw water from the toilet bowl into the discharge chamber; and an air pipe which extends between a down pipe from the water reservoir and the interior of the water reservoir such that initial outflow of water from the reservoir through the downpipe displaces a limited volume of air from the downpipe to the interior of the water reservoir thereby to provide initial partial relief of the reduction in air pressure in the water reservoir.

24. A toilet flushing system comprising a water reservoir provided with a water inlet, and a water outlet for directing water to an associated toilet bowl, the water reservoir having an upper end;

a discharge chamber connected to a discharge outlet of the toilet bowl; the discharge chamber having at a downstream location thereof an exit opening provided with closure means for closing the exit opening;

an air conduit extending between an upper end of the water reservoir and the discharge chamber such that a reduction in air pressure within the upper end of the water reservoir produces temporarily in the discharge chamber a partial vacuum thereby to draw water from the toilet bowl into the discharge chamber;

wherein the water reservoir is adapted to dispense a volume of water which is less than 7 liters for a single flush operation, and the water inlet is of restricted diameter relative to the water outlet so as to allow controlled refilling of the reservoir after a fall in the level of water therein, and wherein the water inlet is linked to a second reservoir provided with a float valve metered water supply.

25. A toilet flushing system according to claim 24 wherein the water reservoir is adapted to dispense a volume of water which is no more than 4 litres for a single flushing operation.

26. A toilet flushing system according to claim 24 wherein the water inlet is linked to the second reservoir via a water trap.

27. A toilet flushing system according to claim 24 wherein the closure means is selected from the group consisting of a flap, a plunger and a valve operatively linked to a float.

28. A toilet flushing system according to claim 24 which is provided with a siphonic mechanism disposed within the water reservoir, actuation of the siphonic mechanism serving to initiate the fall in water level in the reservoir thereby generating the partial vacuum.

29. A toilet flushing system according to claim 24 wherein the closure means at the exit opening of the discharge chamber is uni-directional.

30. A toilet flushing system according to claim 29 wherein the closure means takes the form of a one-way flap valve.

31. A toilet flushing system according to claim 24 wherein the closure means at the exit opening is defined by a water trap.

32. A toilet flushing system according to claim 31 wherein the water trap is a U-bend water trap.

33. A toilet flushing system according to claim 24 wherein the water outlet comprises an outlet pipe provided with a U-bend defining a water trap which prevents air escape into the toilet bowl.

34. A toilet system comprising a toilet bowl and a flushing system;

the flushing system comprising a water reservoir provided with a water inlet, and a water outlet for directing water into the toilet bowl, the water reservoir having an upper end;

a discharge chamber connected to a discharge outlet of the toilet bowl; the discharge chamber having at a downstream location thereof an exit opening provided with closure means for closing the exit opening;

an air conduit extending between the upper end of the water reservoir and the discharge chamber such that a reduction in air pressure within the upper end of the water reservoir produces temporarily in the discharge chamber a partial vacuum thereby to draw water from the toilet bowl into the discharge chamber;

wherein the water reservoir is adapted to dispense a volume of water which is less than 7 liters for a single flushing operation, and the water inlet is of restricted diameter relative to the water outlet so as to allow controlled refilling of the reservoir after a fall in the level of water therein, and wherein the water inlet is linked to a second reservoir provided with a float valve metered water supply.

* * * * *